US006739846B2

(12) United States Patent
Stoddard et al.

(10) Patent No.: US 6,739,846 B2
(45) Date of Patent: May 25, 2004

(54) STACKED REDUNDANT BLOWERS

(75) Inventors: Donald Joseph Stoddard, San Jose, CA (US); Michael Hansen, Pleasanton, CA (US)

(73) Assignee: Maxxan Systems, Inc., San Jose, CA (US)

( * ) Notice: Subject to any disclaimer, the term of this patent is extended or adjusted under 35 U.S.C. 154(b) by 15 days.

(21) Appl. No.: 10/202,264

(22) Filed: Jul. 24, 2002

(65) Prior Publication Data

US 2004/0018105 A1 Jan. 29, 2004

(51) Int. Cl.[7] ..... F04B 17/00; F04B 35/04

(52) U.S. Cl. ..... 417/423.5; 415/199.4; 361/688

(58) Field of Search ..... 417/423.5, 423.1, 417/426, 423.14; 415/199.5, 199.4, 199.6, 203, 206, 60; 361/687, 688, 692, 695

(56) References Cited

U.S. PATENT DOCUMENTS 3,241,173 A * 3/1966 Finn ..... 15/328
4,118,826 A * 10/1978 Kaeser ..... 15/328
4,935,968 A * 6/1990 Hunt et al. ..... 5/713
5,478,214 A * 12/1995 Howarth et al. ..... 417/423.5
5,546,272 A * 8/1996 Moss et al. ..... 361/687
5,629,560 A * 5/1997 Katsui et al. ..... 257/712
5,701,045 A * 12/1997 Yokozawa et al. ..... 310/62
5,839,205 A * 11/1998 Hung ..... 34/97
6,244,818 B1 * 6/2001 Chang ..... 415/208.2
6,396,688 B1 * 5/2002 Davies et al. ..... 361/687
6,407,918 B1 * 6/2002 Edmunds et al. ..... 361/695
6,626,653 B2 * 9/2003 Lin et al. ..... 417/423.5

* cited by examiner

*Primary Examiner*—Justine R. Yu
*Assistant Examiner*—Han L Liu
(74) *Attorney, Agent, or Firm*—Trop, Pruner & Hu, P.C.

(57) ABSTRACT

A fluid moving system is disclosed wherein a plurality of stacked blowers may provide for the redundant supply of cooling fluid such as air. This system may be advantageously utilized to cool electronic equipment or other uses. One or more of the blowers may utilize an impellor design that allows for the axial flow of fluid through the blower in addition to a transverse fluid outlet. In addition, the blowers may incorporate a flow gate operative to reduce back flow should a particular blower have a reduced fluid flow.

9 Claims, 3 Drawing Sheets

STACKED REDUNDANT BLOWERS

FIELD OF THE INVENTION

The present relates to the field of airflow management and in particular to cooling systems that may be suitable for electronic equipment.

BACKGROUND

Modern day electronic equipment often includes multiple subsystems mounted within a relatively small cabinet for protection and for the convenience of the user. However, such arrangements tend to concentrate large amounts of heat within a constrained area. This heat must be removed for system reliability and safety reasons from the cabinet. Often, the extreme density of electronics within the cabinet necessitates a high airflow rate and relatively high pressure to accomplish the heat removal. In addition, to provide for redundancy and high reliability of the electronic systems, it may be preferred to provide for a heat removal and cooling system that is not totally dependent on a single air mover.

Centrifugal blade blowers may provide for high pressure and high volume air movement that may be suitable for electronic cooling. However, because of the construction of the impeller typically provided on the blower, it is very difficult and inefficient to provide for redundant blowers for a single cabinet. One difficulty in providing redundant centrifugal blowers is based on the typical construction of the blowers. The centrifugal blowers have impellers that typically have a solid base structure that prevents air from flowing in a direction other than transverse to the inlet. This may dictate that blowers may have to be mounted side by side if redundancy is desired. A side by side mounting may not be desirable due to changes in airflow patterns if an individual blower fails and other reasons Therefore, what is needed is an airflow method and apparatus that provides redundancy while sustaining the required total airflow and maintaining the same airflow patterns within a cabinet and other advantages.

BRIEF DESCRIPTION OF THE DRAWINGS

The invention may be best understood by referring to the following description and accompanied drawings that are used to illustrate embodiments of the invention. In the drawings.

DETAILED DESCRIPTION

Figure 1:
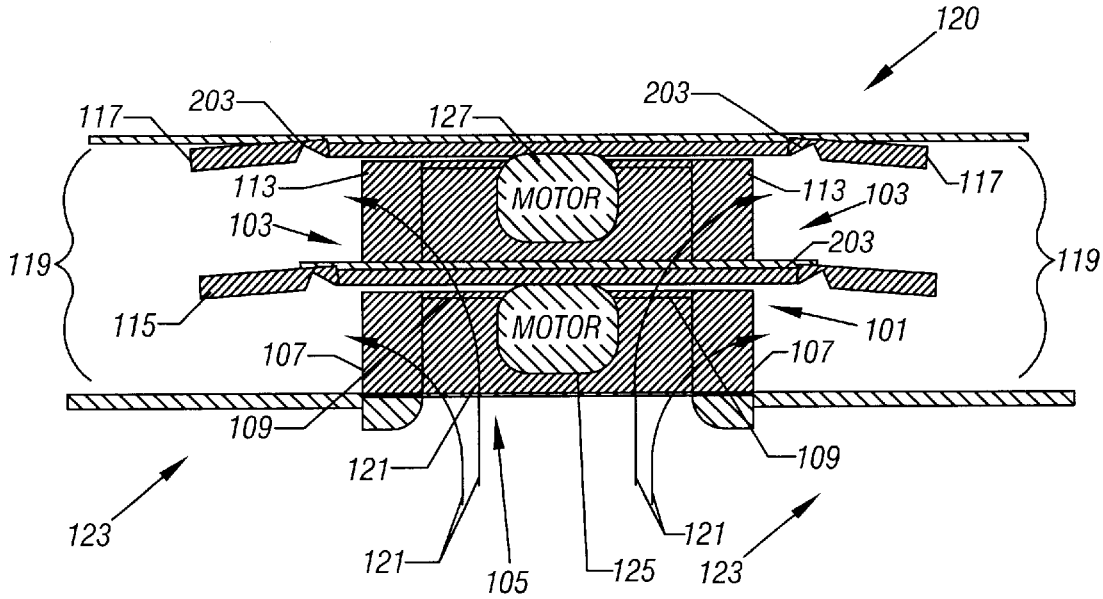
FIG. 1 illustrates stacked centrifugal blower according to embodiments of the present invention.

Referring now to FIG. 1, two centrifugal blowers 101 and 103 are stacked such that the centrifugal blower 103 is mounted above the centrifugal blower 101. The centrifugal blower 101 has an inlet area 105 and a first exhaust area 107. Additionally, centrifugal blower 101 has a pass through air passage 109.

In like manner, the centrifugal blower 103 has an inlet area 111 and an exhaust area 113. Also, each of the centrifugal blowers 101 and 103 include an airflow gate 115 and 117 respectively.

In operation, air is drawn from the inlet 105 of centrifugal blower 101 and exhausted by centrifugal blower 101 through exhaust area 107. In addition, centrifugal blower 103 draws air through the pass through area 109 in centrifugal blower 101 and into the inlet area 111 of blower 103. Centrifugal blower 103 then exhausts the air from inlet 111 through exhaust area 113.

Exhaust areas 107 and 113 exhaust air into a plenum area indicated generally by 119. With both centrifugal blowers 103 and 101 operational, the air exhaust gates 115 and 117 are held in an open position by the airflow pressure provided by the centrifugal blowers 101 and 103 respectively.

As illustrated, airflow as illustrated by arrows 121, air flows from a bottom area 123 up through the centrifugal blowers and into the plenum area 119.

Figure 2:
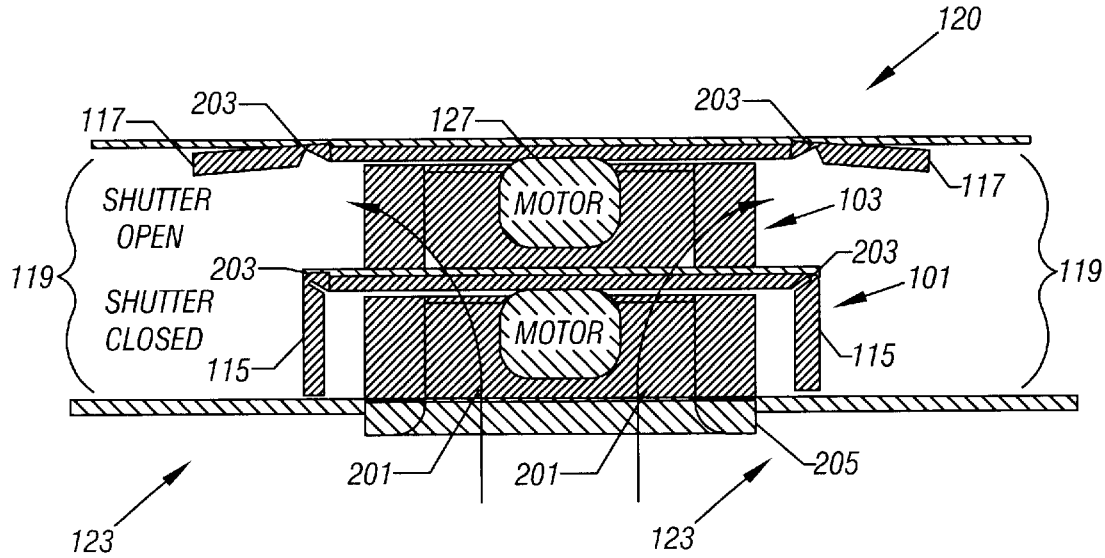
FIG. 2 illustrates stacked centrifugal blowers wherein one blower is operational.

Referring now to FIG. 2, centrifugal blower 101 may have a reduced or zero airflow while centrifugal blower 103 is operational. In this case, air, as illustrated by airflow lines 201, is pulled by centrifugal blower 103 from area 123 and exhausted into the plenum area 119. As centrifugal blower 101 has reduced or no airflow, exhaust gates 115 are in a more closed position thereby reducing pressure losses from the plenum area 119 through the centrifugal blower 101. The exhaust gates 115 may be forced into a more closed position by airflow pressure in the plenum area 119 acting on the outside of the exhaust gate and thereby pushing it toward centrifugal blower 101. However, other mechanisms are possible also. As an additional example, a spring loaded exhaust gate may be utilized to bias the exhaust gate closed should centrifugal blower 101 have a reduced air flow. It is also possible to attach the exhaust gates to the impeller plate. The gates would then be opened by centrifugal force. Their closure would then be achieved by the weight of the gates pulling the gates down. In other embodiments, the gates may be biased toward a closed position by springs, air pressure or by other force.

Each of the exhaust gates may also be responsive to open based, in part, on the flow rate of the associated blower. For example, exhaust gates 115 may open, in part or fully, based on the air flow from the centrifugal blower 101.

In like manner, centrifugal blower 103 incorporates exhaust gates 117 which may also become in a more closed position should centrifugal blower 103 have reduced or no airflow.

Exhaust gates 115 and 117 may include a hinge area 203. This hinge may be incorporated into the exhaust gate. As illustrated, hinge area 203 has a reduced cross section which may tend to create a bendable, or flexible, area. However, other hinge arrangements are also possible. For example, a metal hinge, a fabric hinge, an elastomeric hinge or other hinge may be utilized to achieve the advantageous results.

Figure 3:
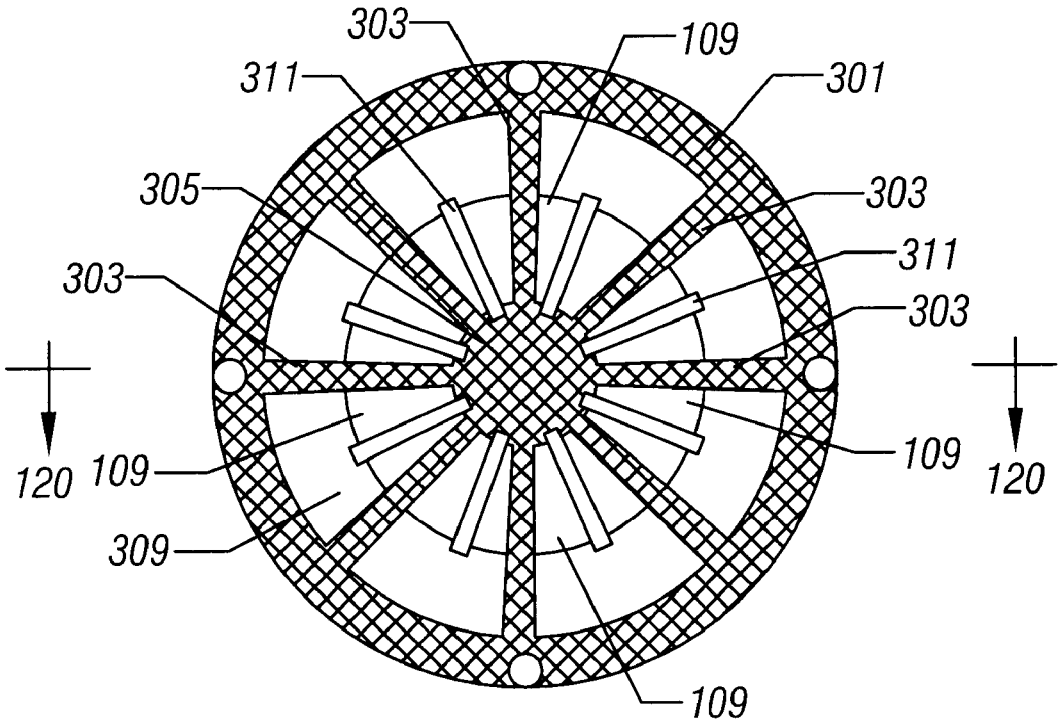
FIG. 3 illustrates a centrifugal blower mounting system according to embodiments of the present invention.

Referring now to FIG. 3, an external frame 301 includes spokes 303 and a hub 305. Additionally, frame 301 includes airflow pass through areas 109. A centrifugal impellor 309 may be suspended from a motor such a motors 125 and 127 (not shown) by spokes 311.

Impellor 309 may be representative of impellers 107 and 113 respectively. The frame 310 may be mounted to an exhaust gates such as exhaust gates 115 and 117 thereby suspending the motor and the attached impellor 309 below the frame. The air pass through areas 109 permit air to pass from the inlet area such as area 105 associated with centrifugal blower 101 to pass axially through the center of the centrifugal blower to a centrifugal blower stacked above it such as the arrangement illustrated in FIGS. 1 and 2 with respect to blowers 101 and 103.

Upon the failure or a reduced operating capability of a single centrifugal blower in a stacked arrangement, the operational centrifugal blower may provide the required airflow for cooling or other purposes. Additionally, the speed of an operational centrifugal blower may be adjusted to provide a suitable airflow upon the failure of one or more other centrifugal blowers. Also, while the present method and apparatus is described for providing airflow and pressure, the same system may be utilized to provide for other fluid flow and fluid pressures for the same or other applications.

Figure 4:
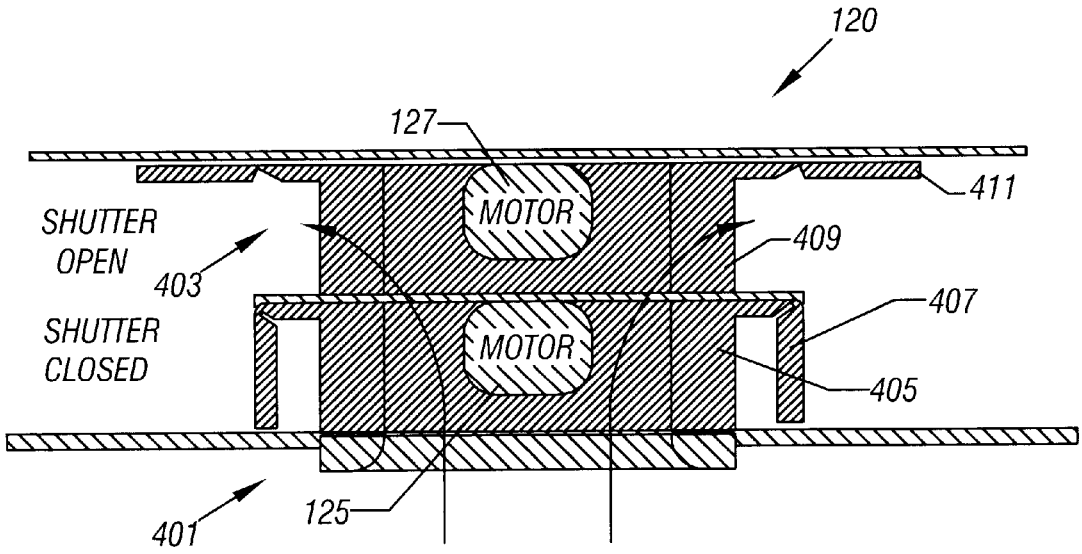
FIG. 4 illustrates a centrifugal blower having a flow gate coupled to the impeller according to embodiments of the present invention.

Referring now to FIG. 4, blowers 401 and 403 each include an impellers 405 and 407 respectively. Each of the impellers 405 and 407 includes a flow gate 409 and 411 respectively. The flow gates may be coupled to the impellor by an integrated hinge or other attachment. As the impellor spins, the flow gates open allowing air or other flow to occur. The flow gates 409 and 411 may be forced open by centrifugal force, force from the air or other flow, or other force applied to the flow gates. As discussed above, should one of the blowers have reduced air or other flow, the gate may close fully or partially.

While the present invention has been described with respect to a limited number of embodiments, those skilled in the art will appreciate numerous modifications and variations there from. For example, while two stacked blowers have been illustrated and described, the use of three or more stacked blowers may be utilized. In addition, the air flow of one or both of the blowers may be adjusted individually or collectively to provide for a desired air flow or air pressure for cooling or other purposes. Still additionally, while each blower has been illustrated and described as having a single impeller, other variations may be possible. For example, one or more of the blowers may utilize multiple impellers or impellers and stators. Also, while the blowers have been illustrated and described has only having two exhausts, the one or more of the blowers may be constructed with from one exhaust area to a substantially continuous exhaust area substantially surrounding the impeller(s).

Therefore, it is intended that the appended claims cover all such modifications and variations that fall within the true spirit and scope of the present invention.

What is claimed is:

1. A fluid moving system comprising:

a first fluid mover utilizing an impeller and having a fluid input and a fluid output in a generally side outlet:

the first fluid mover also having a second fluid outlet generally opposite the fluid input;

a second fluid mover utilizing an impeller and having an input generally axially coupled to the first fluid mover second fluid output, the second fluid mover also having a generally side fluid output; and the first and second fluid movers also each having a flow gate coupled to the generally side output and each flow gate being operative to open, based, in part, on a fluid flow from an associated fluid mover.

2. The fluid moving system of claim 1 wherein the first fluid mover is a centrifugal blower.

3. The fluid moving system of claim 1 wherein the second fluid mover is a centrifugal blower.

4. The fluid moving system of claim 1 wherein the flow gate associated with the first fluid mover is operative to close based, in part, on a fluid flow from the second fluid mover.

5. The fluid moving system of claim 1 wherein the flow gate associated with the second fluid mover is operative to close based, in part, on a fluid flow from the first fluid mover.

6. The fluid moving system of claim 1 wherein the first fluid mover impeller includes a base section with impeller blades generally on the periphery of the base section and the base section includes flow through apertures generally constructed to allow fluid flow to pass from a first surface of the base section through the base section.

7. The fluid moving system of claim 1 wherein the second fluid mover impeller includes a base section with impeller blades generally on the periphery of the base section and the base section includes flow through apertures generally constructed to allow fluid flow to pass from a first surface of the base section through the base section.

8. The fluid moving system of claim 1 wherein the flow gate associated with the first fluid mover is coupled to the first flow mover with a hinge.

9. The fluid moving system of claim 1 wherein the flow gate associated with the second fluid mover is coupled to the second flow mover with a hinge.

* * * * *